United States Patent [19]

Hall

[11] Patent Number: 4,776,809

[45] Date of Patent: Oct. 11, 1988

[54] LOW VOLTAGE DISTRIBUTION SYSTEM WITH TWO-CONDUCTOR TRACK

[75] Inventor: Stephen Hall, London, Great Britain

[73] Assignee: Light Source Electrical Equipment Limited, London, England

[21] Appl. No.: 36,265

[22] Filed: Apr. 9, 1987

[30] Foreign Application Priority Data

Apr. 11, 1986 [GB] United Kingdom ..... 8608900

[51] Int. Cl.[4] ..... H01R 25/14

[52] U.S. Cl. ..... 439/116; 439/121; 439/527; 248/222.3

[58] Field of Search ..... 439/110–122, 439/207–216, 296, 313, 338, 342, 343, 345, 351, 10, 13, 18–29, 527, 532, 533, 576; 248/222.3; 362/147

[56] References Cited

U.S. PATENT DOCUMENTS

| | | | |
|---|---|---|---|
| 2,124,269 | 7/1938 | Anderson et al. | 439/211 |
| 3,129,751 | 4/1964 | Weber | 248/222.3 |
| 3,243,754 | 3/1966 | Miller | 439/207 |
| 3,686,614 | 8/1972 | Hyrylainen | 439/122 |
| 3,933,403 | 1/1976 | Rubesaimen et al. | 439/121 |
| 4,289,365 | 9/1981 | Rutgers | 439/122 |
| 4,688,869 | 8/1987 | Kelly | 439/209 |

FOREIGN PATENT DOCUMENTS

| | | | |
|---|---|---|---|
| 2104669 | 8/1971 | Fed. Rep. of Germany | 439/207 |
| 2210516 | 9/1973 | Fed. Rep. of Germany | 439/207 |

*Primary Examiner*—Gil Weidenfeld
*Assistant Examiner*—Gary F. Paumen
*Attorney, Agent, or Firm*—Leydig, Voit & Mayer, Ltd.

[57] ABSTRACT

A low voltage distribution system comprises a two-conductor track of which one conductor is an outer conductor formed by its casing and the other conductor is an inner copper strip held by insulation. An adaptor can be fitted anywhere along the track and interlocked by closing pivoted members so that portions displace resilient arms outwardly to interlock lips of the adaptor with lips of the track. A fully rotatable contact assembly includes a center contact inside a sleeve contact as well as a lamp bracket which rotates as one with the contact assembly so that wires to the lamp never get twisted. For ease of mounting, a fixing device comprises a rotatable member which can be mounted to a support by a center screw and having a slot or opening to receive a connecting piece which is slidably connected to the back of the track casing by undercut tongue and groove.

21 Claims, 9 Drawing Sheets

LOW VOLTAGE DISTRIBUTION SYSTEM WITH TWO-CONDUCTOR TRACK

BACKGROUND OF THE INVENTION

Field of the Invention

This invention relates to a low voltage distribution system with a two-conductor track.

By "low voltage" is meant fifty volts or less.

The invention has for its principal object the provision of a two-conductor track which will take an adaptor anywhere along the track for energising, for example, an electric lamp.

Another object is to provide an adaptor which will carry a lamp which can be rotated freely on the adaptor without twisting wires connecting the lamp to a rotatable contact assembly of the adaptor.

Another object is to make the track easily mountable to a support.

Another object is to provide a power supply connector which incorporates overload protection means.

SUMMARY OF THE INVENTION

The invention has various aspects.

According to a first aspect of the invention there is provided a low voltage distribution system comprising a two-conductor track and an adaptor which can be fitted thereto anywhere along the track, the adaptor comprising means for making electrical contact with the two conductors and means for interlocking mechanically with the track, including at least one movable member for positively displacing at least one interlocking member into interlocking engagement with the track, the interlocking member being resiliently biased out of said interlocking engagement.

According to a second aspect of the invention there is provided a low voltage two-conductor track comprising an outer metal casing forming at least part of one of the conductors, an inner metal conductor forming the other of the conductors and insulation supporting the inner metal conductor within the outer metal casing and insulating the two conductors electrically from each other, said outer metal casing, inner metal conductor and insulation all extending continuously along the whole length of the track, both conductors being exposed for electrical contact therewith by an adaptor applied to the track anywhere along the length of the track.

According to a third aspect of the invention there is provided a low voltage distribution system comprising a two-conductor track and an adaptor which can be fitted thereto anywhere along the track, the adaptor comprising a support which can be mechanically interlocked with the track, and an electrical contact assembly which is freely rotatably carried by the support, said contact assembly comprising an electrical centre contact and an electrical outer contact adapted and arranged for respectively contacting the two conductors of the track in any rotational position, two terminals connected electrically to the two contacts respectively and rotatable as one therewith, and insulating support means for the contact and terminals, said insulating support means also being rotatable as one therewith.

According to a fourth aspect of the invention there is provided a low voltage two-conductor track in combination with a fixing device for fixing the track to a support, the fixing device comprising a mounting member mounted or adapted to be mounted rotatably to the support and a connecting piece slidingly connected or adapted to be slidingly connected to the track by means of an undercut tongue and groove, the mounting member being adapted to receive the connecting piece in one rotational position and to interlock therewith in another rotational position.

BRIEF DESCRIPTION OF THE DRAWINGS

Like references refer to like parts throughout.

DESCRIPTION OF THE PREFERRED EMBODIMENTS

Figure 1:
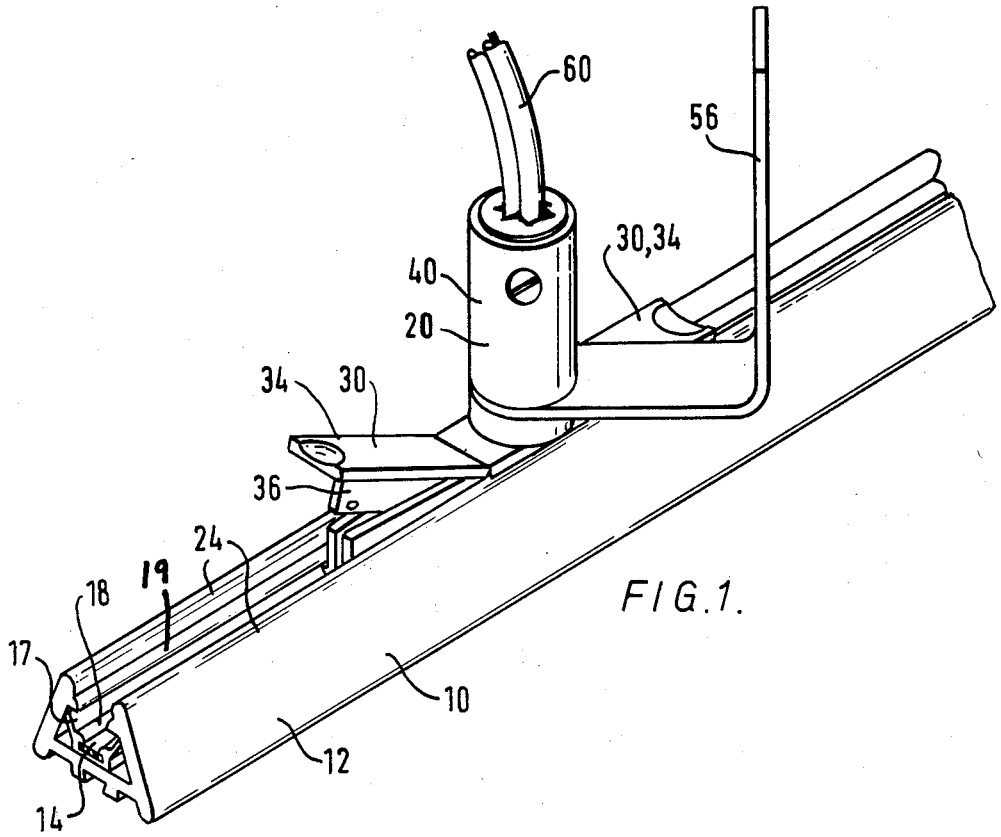
FIG. 1 illustrates a track and an adaptor.
Figure 2:
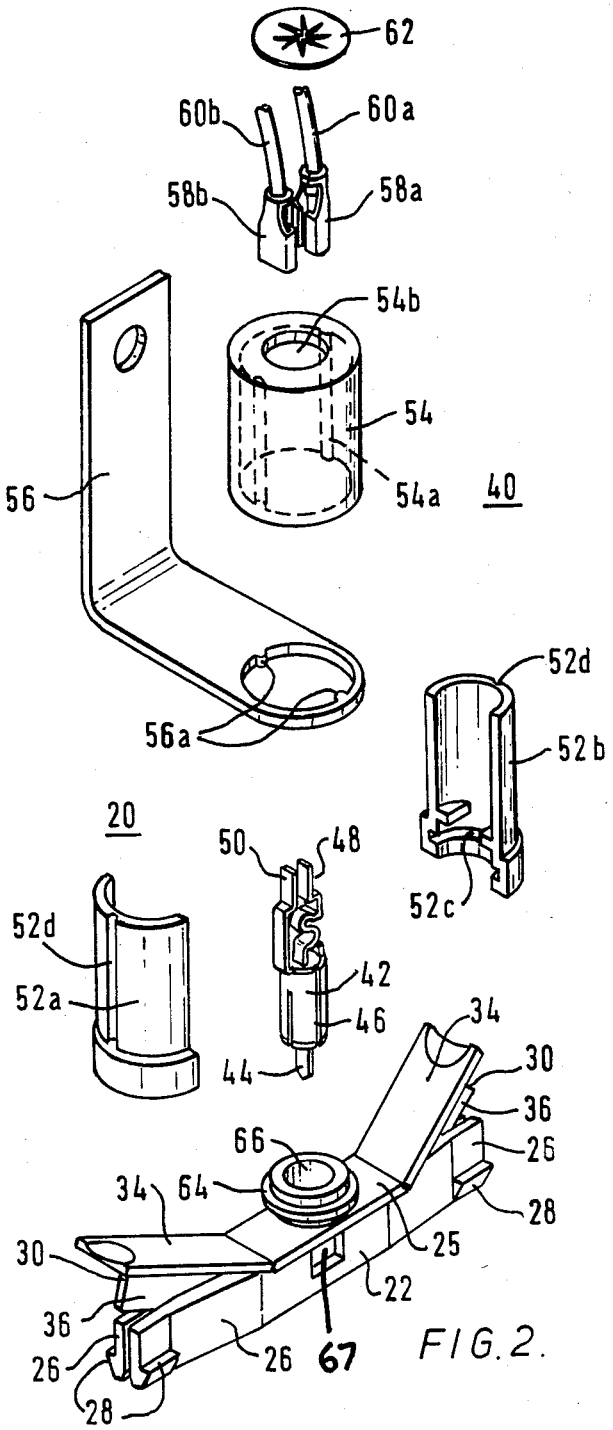
FIG. 2 is an exploded view of the adaptor.
Figure 3:
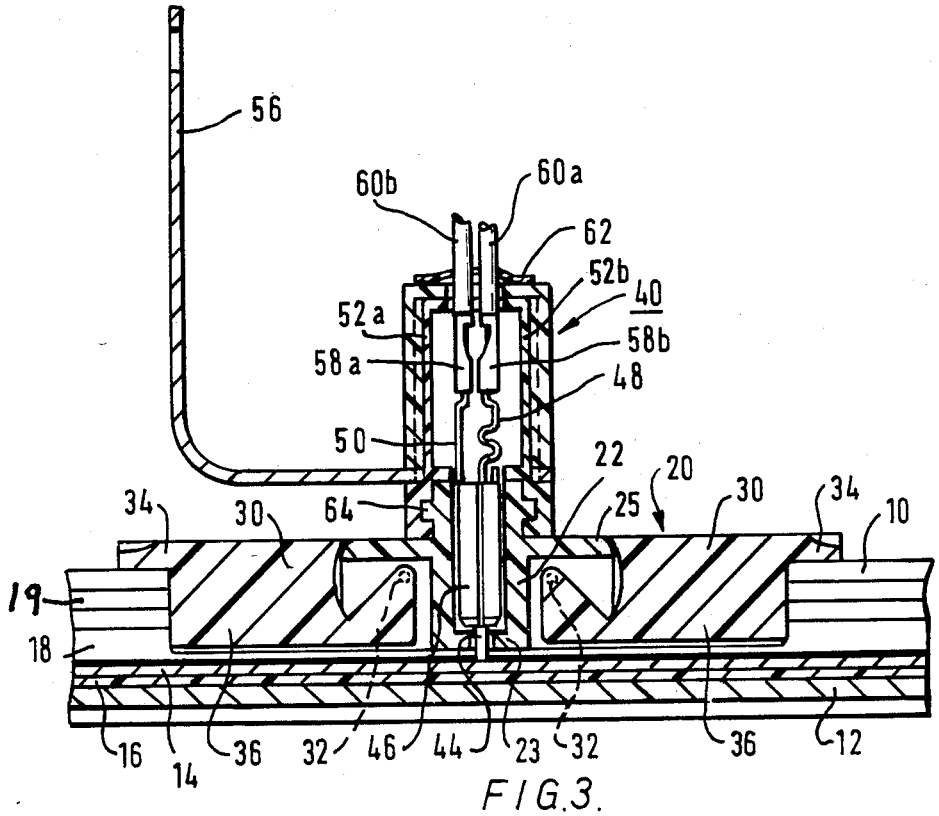
FIG. 3 is a section of the track and the adaptor.

Referring to FIGS. 1 to 3, the illustrated track 10 is a two-conductor track of which one conductor is an outer conductor formed by an extruded aluminum casing 12 and the other conductor is an inner conductor formed by a copper strip 14 which is insulated by insulation 16, the strip 14 being held in place by lips 18 of insulation 16. The conductors 12 and 14 and insulation 16 all extend continuously (with uniform cross-sections) along the whole length of the track, the conductors 12 and 14 being exposed for electrical contact therewith by an adaptor 20 applied to the track 10 anywhere along the length of the track. The insulation 16 is of extruded plastic, having wings 17 which are held resiliently in place under lips 19 of casing 12.

The adaptor 20 comprises a plastic insulating body 22 which fits between two sides 24, 24 of the track 10, being somewhat narrower than an integral flat plastic top 25 which abuts the track sides 24, 24. Two pairs of resilient cantilever arms 26, 26, 26, 26 extend longitudinally of the body 22 in mutually opposite directions and are integral with the body 22. The tip of each arm 26 is formed with an outwardly projecting lip 28 which is interlockingly engageable with a respective one of the lips 19 of casing 12. The normal (i.e. unstressed) positions of arms 26 are inward disengaging lips 28 from lips 19.

For biasing arms 26 outward to interlock lips 28 with lips 19, the adaptor 20 comprises two pivoted members 30 which can be selectively pivoted from the 'open' position of FIG. 2 (for disengagement) to the 'closed' position of FIG. 3 (in which they displace the two pairs of arms 26 apart into interlocking engagement with the track 10), about pivots 32. The two members 30 have flat tops 34 which lie flush with the top 25 of the body 22 in the closed position of FIG. 3. It will be appreciated that the space between each pair of arms 26, 26 is 'normally' (i.e. when unstressed) narrower than portion 36 of the respective member 30 which comes between them.

The adaptor 20 also comprises a rotatable contact assembly 40 which makes electrical contact with the track 10 in any rotational position. The contact assembly 40 comprises a sub-assembly 42 (FIG. 2) of an electrical centre contact 44 (to contact the strip 14) and a split sleeve outer electrical contact 46 (to contact the lips 19 of casing 12). An insulating plastic grommet (not shown) inside the sleeve contact 46 receives and positions the centre contact 44. The sub-assembly 42 also includes two metal connector tags 48, 50 which are respectively integral with contacts 44, 46. Near where the centre contact 44 engages conductor 14, it is located at a bottom end wall 23 of body 22.

The contact assembly 40 also comprises, besides the sub-assembly 42, two semi-cylindrical half inner insulating sleeves 52*a*, 52*b*, an outer sleeve 54, a bracket 56, two electrical connector terminals 58*a*, *b* (respectively crimped to insulation-covered wires 60*a*, *b*) and a washer 62.

As assembled, the half sleeves 52*a*, 52*b* encase the sub-assembly 42; a flange 64 of an upstanding integral boss 66 of body 22 is rotatably received in a circular groove 52*c* of sleeves 52*a*, 52*b* to retain the contact assembly 40 on the body 22. The bracket 56 fits over the half sleeves 52*a*, 52*b* and has two tongues 56*a* which engage grooves 52*d* in half sleeves 52*a*, *b* to lock bracket 56 against rotating relative thereto. The outer sleeve 54 also fits over half sleeve 52*a*, *b* and has tongues 54a engaging grooves 52*d* to prevent relative rotation. The terminals 58*a*, *b* fit onto the tags 48, 50, the wires 60*a*, *b* extending through the centre hole 54*b* in the top of the sleeve 54 and through the washer 62.

The bracket 56 is adapted to support a spot-lamp (not shown) or other illuminating device, to which the wires 60*a*, *b* are connected (not shown). Because the entire contact assembly 40 (that is, sub-assembly 42, half-sleeves 52*a*, *b*, outer sleeve 54, bracket 56, terminals 58*a*, *b*, wires 60*a*, *b* and washer 62) rotates as one unit, the wires 60*a*, *b* never get twisted, either around themselves or around the bracket 56.

Furthermore, because the contacts 44 and 46 are respectively a centre contact and a sleeve contact of annular cross-section (both being co-axial with the axis of rotation) electrical contact is made with copper strip 14 and with the lips 19 of casing 12 respectively in all rotational positions of contact assembly 40. The centre contact 44 projects beyond end wall 23 of body 22 to engage strip 14, while sleeve contact 46 bulges outwardly of an aperture 67 at each side of the body 22 to engage the lips 19 of casing 12.

The adaptor 20 can be fitted to the track 10 anywhere along its length with the members 30 initially 'open' as shown in FIGS. 1 and 2, and locked in position by closing members 30 to the position of FIG. 3 in which arms 26 are displaced positively outwardly to interlock lips 28 with lips 19.

Figure 4:
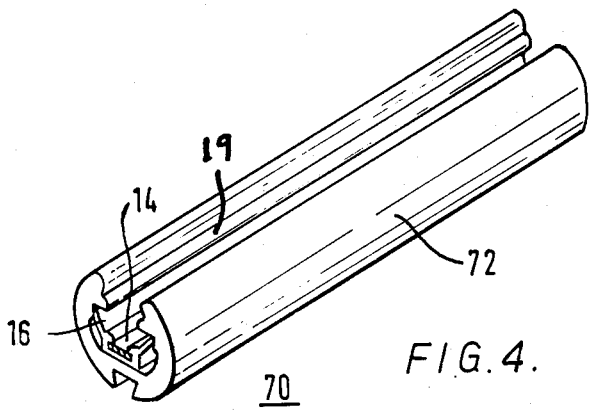
FIG. 4 illustrates a modified track.
Figure 5:
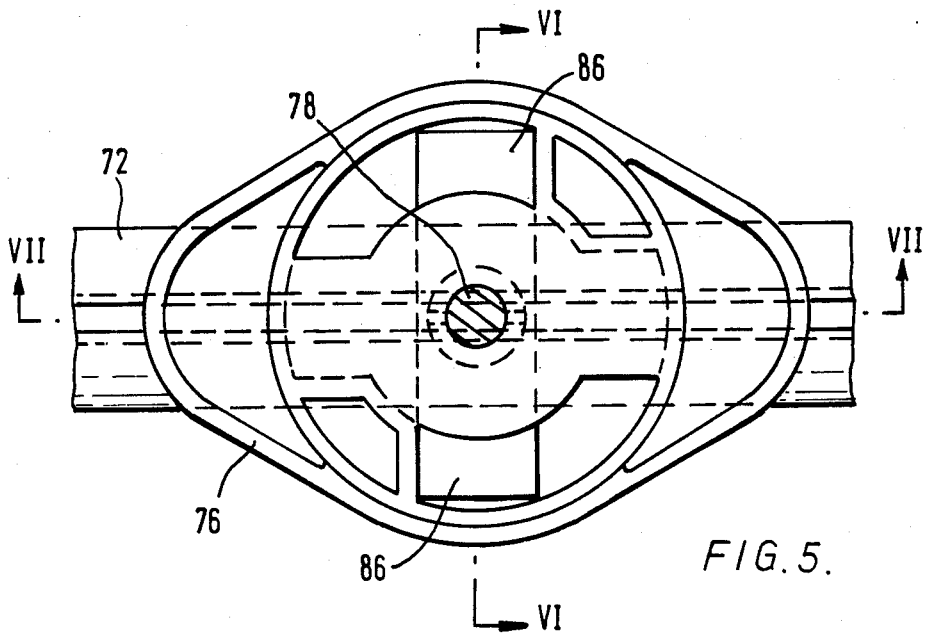
FIG. 5 illustrates the casing of the modified track and a fixing device, in plan view.

FIG. 4 illustrates a modified track 70 having a casing 72 of generally rounded, cylindrical configuration, in contrast to the rather angular configuration of casing 12 of track 10. In other respects the track 70 is similar to track 10.

Figure 6:
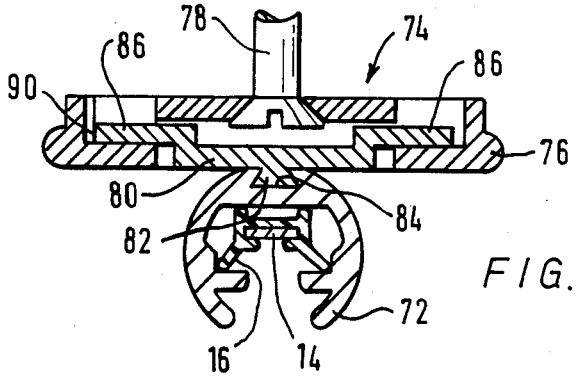
FIGS. 6 and 7 are sections on lines VI—VI and VII—VII respectively of FIG. 5.
Figure 7:
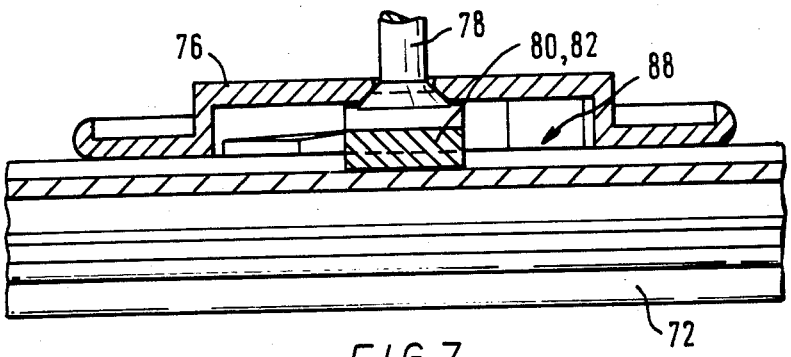
Figure 8:
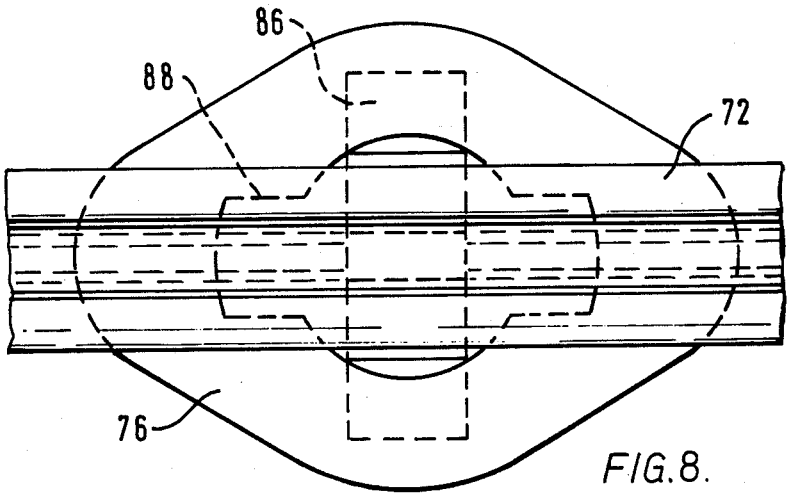
FIG. 8 is an underneath plan view corresponding to FIG. 5.

For mounting the track 10 or the track 70 to a support, referring to FIGS. 5 to 8 (which happen to show the modified track 70, with copper strip 14 and insulation 16 shown only in FIG. 6) a fixing device 74 is provided comprising a mounting member 76 mounted rotatably to the (not shown) support (e.g. by a screw 78), and a connecting piece 80 slidingly connected to the back of the casing 72 by means of engaging an undercut tongue 82 of the connecting piece 80 in an undercut groove 84 in casing 72. Laterally projecting wings 86 of connecting piece 80 are received through a rectangular opening 88 in the outside face of mounting member 76, which can then be rotated to retain the wings 86 in recesses 90 in mounting member 76. Since connecting piece 80 is slidable along the casing 72 of track 70, accurate positioning if less critical, making assembly easier.

The track 10 has an undercut groove (not shown) at the back of it, the same as groove 84 of track 70, and hence can be mounted in the same way.

Figure 9:
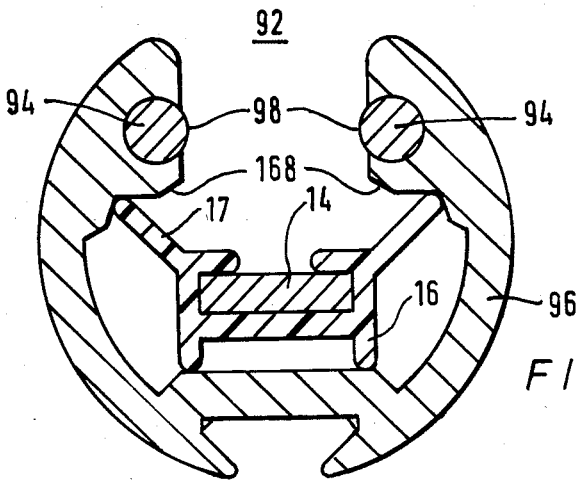
FIG. 9 is a cross-section through another modified track.

The modified track 92 of FIG. 9 differs from the track 70 of FIG. 4 in having two circular cross-sectioned copper rods 94 partly embedded in and extending along the aluminum casing 96. The contact 46 of the adaptor 20 engages and makes electrical contact with exposed inner surfaces 98 of the two copper rods 06. In other respects the track 92 is identical to the track 70.

Figure 10:
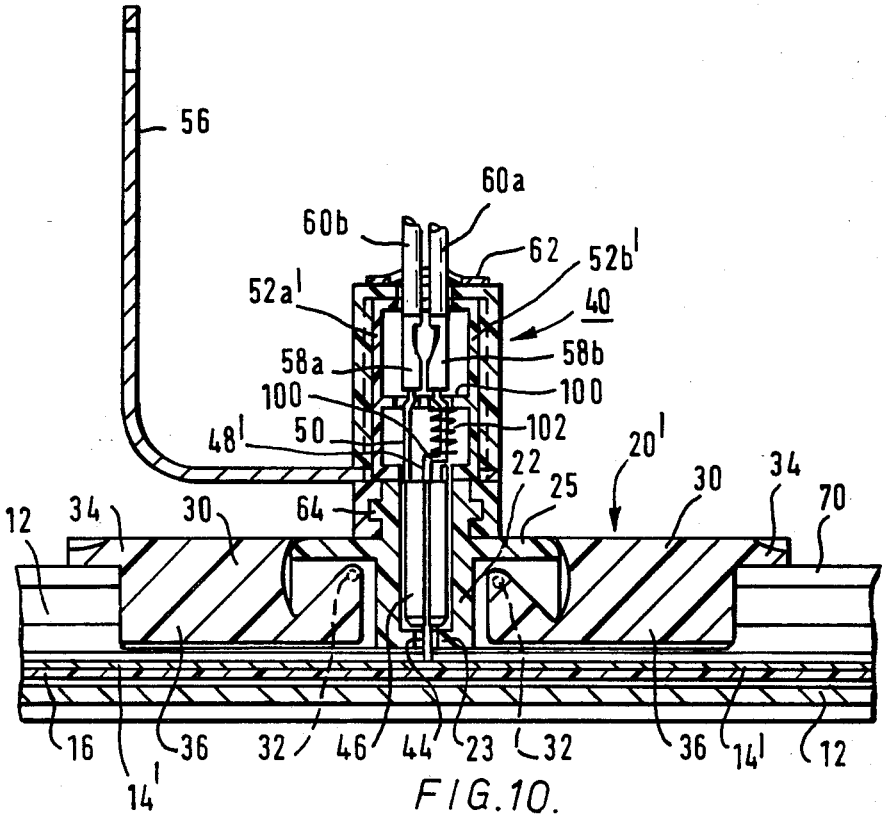
FIG. 10 is a section of a track with a modified adaptor.
Figure 11:
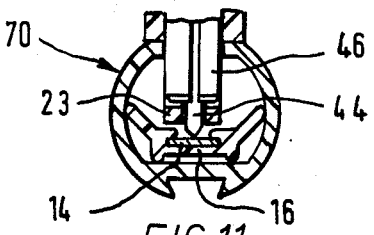
FIG. 11 is a cross-section through the track and part of the adaptor of FIG. 10.

In the modification of FIGS. 10 and 11, as compared with the arrangements described hereinabove, like references refer to like parts. However, the above-mentioned plastic grommet (not shown) of adaptor 20 is omitted from the adaptor 20 of FIG. 10. Furthermore, the half inner sleeves 52*a*', 52*b*' are provided with a cross-partition 100 just below the terminals 58a, 58b as seen in FIG. 10. A modified metal connector tag 48', integral with centre contact 44, carries a compression spring 102 which acts between the partition 100 and a bend at 104 in connector tag 48', to bias the contact 44 down onto the conductor strip 14' of track 70 (compare FIG. 4).

Figure 12:
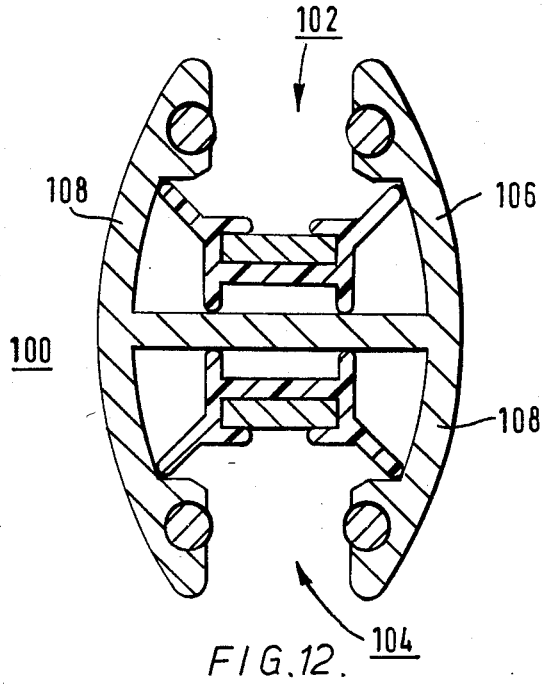
FIG. 12 is a cross-section through a double track.

The double track 100 of FIG. 12 comprises two co-extensive, back-to-back tracks 102 and 104. Each of the tracks 102, 104 is similar to the above-described tracks of FIGS. 1 to 11 apart from the casing shape. The two casings are integral, formed by a unitary casing member 106 which is generally H-shaped except that the sides 108, 108 are (,) - shaped, each being outwardly convex.

Figure 13:
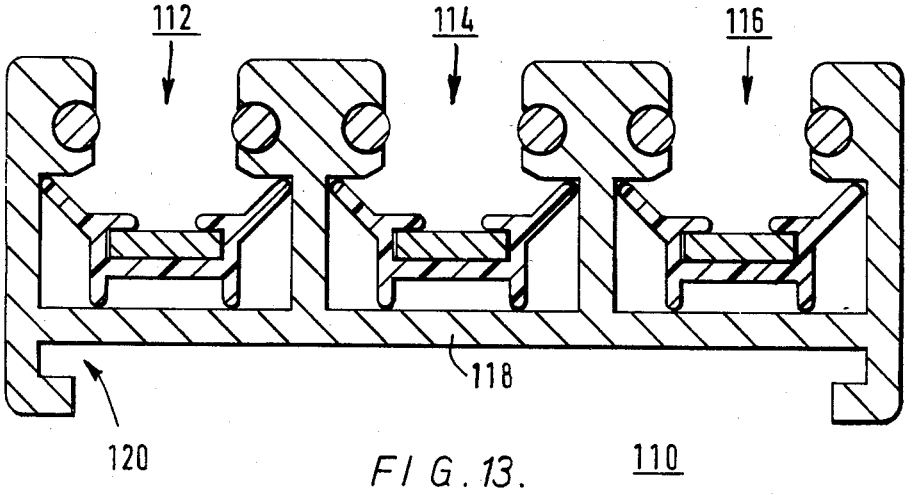
FIG. 13 is a cross-section through a triple track.
Figure 14:
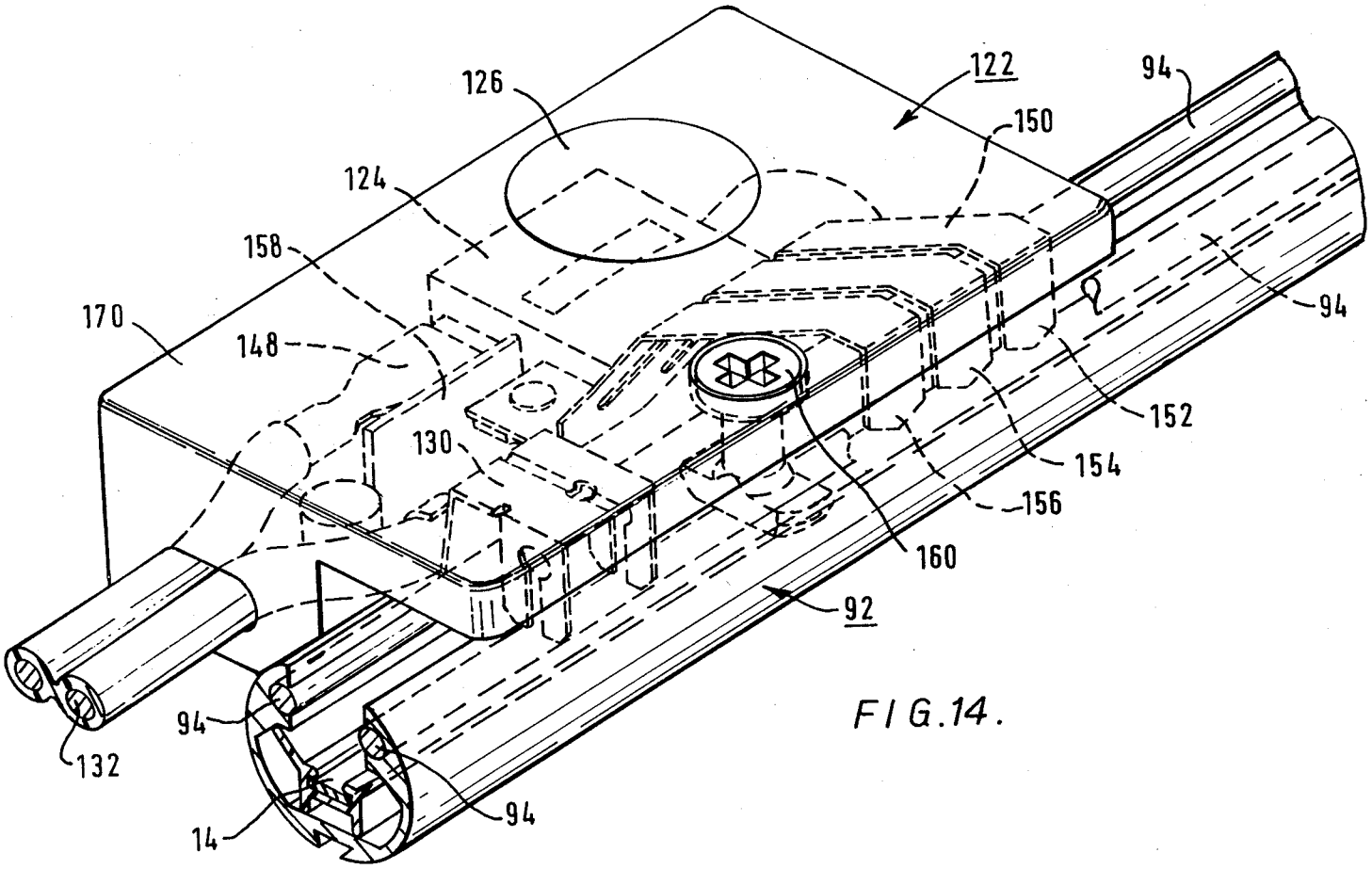
FIG. 14 is a perspective view of a track power supply connector incorporating a thermal cut-out.
Figure 15:
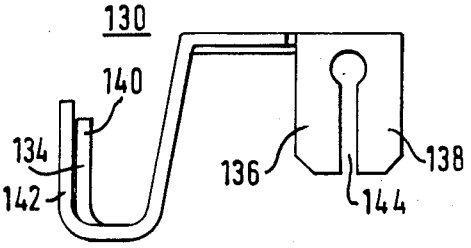
FIGS. 15, 16 and 17 respectively are an end view, a plan view and a side view of a side contact in the connector of FIG. 14.
Figure 18:
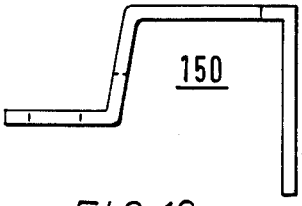
FIGS. 18, 19 and 20 respectively are an end view, a plan view and a side view of a centre contact in the connector of FIG. 14, FIG. 20 being turned through a right angle to fit on the sheet.
Figure 16:
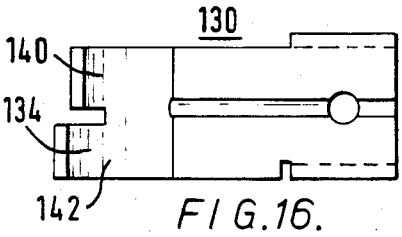
Figure 19:
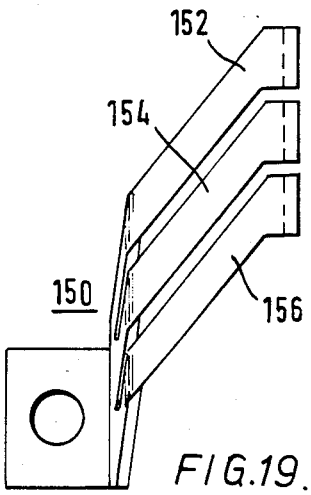
Figure 17:
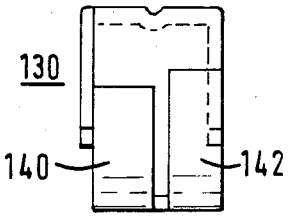
Figure 21:
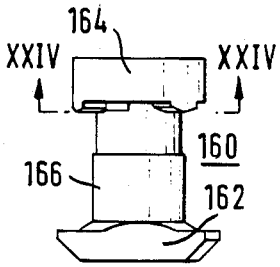
FIGS. 21, 22, 23 and 24 respectively are a side view, a plan view, an underneath plan view and a section on line XXIV—XXIV of FIG. 21, of a rotary locking cam in the connector of FIG. 14.
Figure 22:
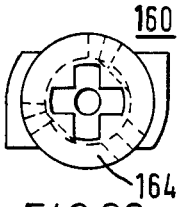
Figure 20:
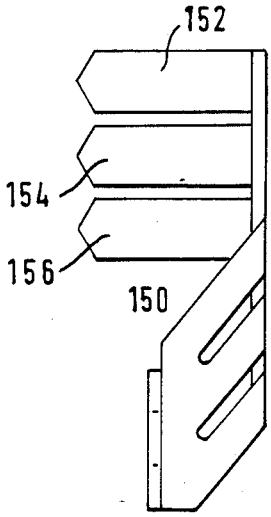
Figure 23:
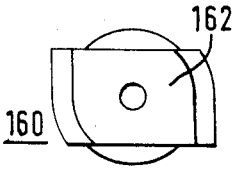
Figure 24:
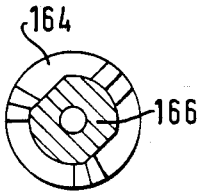

The triple track 110 of FIG. 13 comprises three co-extensive, side-by-side tracks 112, 114, 116 with integral casings formed by a unitary casing member 118.

Whereas the track 10 of FIG. 1 could be described as of generally triangular cross-section and the tracks of FIGS. 4, 6, 9 and 11 as of generally cylindrical cross-section, the track of FIG. 13 is generally rectangular in cross-section and has a rear mounting groove 120.

The two tracks 102, 104 of the double track 100 of FIG. 12 can be separately switched, as can the three tracks 112, 114, 116 of triple track 110 of FIG. 13.

Referring to FIGS. 14 to 24, a track power supply connector 122 incorporates a thermally-activated current-sensitive cut-out device 124 (hereinafter referred to as a thermal cut-out device 124) with a reset button 126 and is adapted to supply electrical power to the track 92 (see also FIG. 9) from a twin-conductor power lead 128.

More particularly, a side contact 130 (FIGS. 14 to 17) of connector 122 connects conductor 132 of power lead 128 electrically to copper rods 94 of track 92. Side contact 130 has a metal ferrule 134 integral with two metal spring contacts 136, 138. The ferrule 134 is crimped in well-known manner to conductor 132, having an inner ear 140 to engage conductor 132 itself and an outer ear 142 to engage the insulation of power lead 128. The spring contacts 136, 138, which are separated by a slot 144, fit springily between conductor rods 94 and engage the side surfaces 98 (FIG. 9) thereof.

The other conductor 146 of power lead 128 is connected to the input of the thermal cut-out device 124 by a ferrule 148. The thermal cut-out device 124 incorporates a mechanism, not illustrated, of well-known type, including a bimetallic strip which carries all the current to the track 92 and which is effective upon excessive current, that is to say an overload, causing corresponding deflection of the strip, to open a pair of electrical contacts of the mechanism so as to cut off electrical power from the track 92. The mechanism is designed for this pair of electrical contacts to remain open until closed (after cooling of the bimetallic strip) upon operation of reset button 126.

A centre contact 150 (FIGS. 14 and 18 to 20) connects the output of the thermal cut-out device 124 to the copper strip 14. The centre contact 150 has three spring contacts 152, 154, 156 which press down upon the copper strip 14. An insulating partition 158 (FIG. 14) separates ferrule 148 from centre contact 150.

To lock the connector 122 onto the track 92, the connector 122 is provided with a rotary locking cam 160 (FIGS. 14 and 21 to 24) comprising a cam head 162 connected integrally to a cross-slotted operating head 164 by a shaft 166. The two "ears" of the cam head 162 engage undersides 168 (FIG. 9) of track 92.

The connector 122 comprises a housing 170 of insulating material that houses the cut-out device 124, contacts 130 and 150 and ferrule 148 and rotatably supports the locking cam 160.

What is claimed is:

1. A low voltage distribution system comprising a two-conductor track and an adaptor which can be fitted thereto anywhere along the track, said adaptor having a plastic body, the adaptor comprising means for making electrical contact with the two conductors, said adaptor further comprising means for interlocking said adaptor mechanically with the track, said interlocking means comprising a pair of opposing plastic arms formed integrally with and hinged integrally to said body in cantilever fashion to swing toward and away from one another, the resiliency of the plastic normally biasing said arms toward one another and out of interlocking engagement with said track, and a member pivotally supported on said body and swingable to an active position between said arms to spread said arms away from one another and into interlocking engagement with said track, said member being selectively pivotable to an inactive position permitting said arms to spring toward one another and out of interlocking engagement with said track.

2. A distribution system as claimed in claim 1 wherein the two-conductor track comprises an outer metal casing forming at least part of one of the conductors, an inner metal conductor forming the other of the conductors and insulation supporting the inner metal conductor withiin the outer metal casing and insulating the two conductors electrically from each other, said outer metal casing, inner metal conductor, and insulation all extending continuously along the whole length of the track, both conductors being exposed for electrical contact with said adaptor applied to the track anywhere along the length of the track.

3. A distribution system as claimed in claim 2 wherein the inner metal conductor is a strip which is retained by two lips of the insulation and wherein two wing portions of the insulation are retained by two lips of the outer metal casing.

4. A distribution system as claimed in claim 2 wherein at least one member of a different metal from the metal of the casing is joined to and extends along the casing for engagement by the electrical contact-making means of the adaptor with an exposed surface of said member of a different metal.

5. A distribution system as claimed in claim 1, the adaptor comprising a support which can be mechanically interlocked with the track, and an electrical contact assembly which is freely rotatably carried by the support, said contact assembly comprising an electrical centre contact and an electrical outer contact adapted and arranged for respectively contacting the two conductors of the track in any rotational position of the contacts, two terminals connected electrically to the two contacts respectively and rotatable as one therewith, and insulating support means for the contacts and terminals, and terminals, said insulating support means also being rotatable as one therewith.

6. A distribution system as claimed in claim 1 and further comprising a track power supply connector for supplying electrical power to the track, the track power supply connector incorporating cut-out means for cutting off power supply from the track in response to an overload.

7. A low voltage distribution system comprising a two conductor track and an adaptor which can be fitted thereto anywhere alaong the track, the adaptor comprising a support which can be mechanically interlocked with the track, and an electrical contact assembly which is freely rotatably carried by the support, said contact assembly comprising an electrical centre contact and an electrical outer contact adapted and arranged for respectively contacting the two conductors of the track in any rotational position of the contacts, two terminals connected electrically to the two contacts respectively and rotatable as one therewith, and insulating support means for the contacts and terminals, said insulating support means also being rotatable as one therewith.

8. A distribution system as claimed in claim 7 wherein the two-conductor track comprises an outer metal casing forming one of the conductors, an inner metal conductor forming the other of the conductors and insulation supporting the inner metal conductor within the outer metal casing and insulating the two conductors electrically from each other, said outer metal casing, inner metal conductor and insulation all extending continuously along the whole length of the track, both conductors being exposed for electrical contact therewith by an adaptor applied to the track anywhere along the length of the track.

9. A distribution system as claimed in claim 8 wherein the inner metal conductor is a strip which is retained by two lips of the insulation and wherein two wing portions of the insulation are retained by two lips of the outer metal casing.

10. A distribution system as claimed in claim 7 wherein the electrical outer contact is of annular cross-section.

11. A distribution system as claimed in claim 7 wherein the electrical outer contact is a sleeve.

12. A distribution system as claimed in claim 7 wherein the adaptor comprises a rotatable bracket which is keyed with the contact assembly to rotate as one therewith.

13. A distribution system as claimed in claim 7 wherein at least one member of a different metal from the metal of the casing is joined to and extends along the casing for engagement by the electrical contact assembly of the adaptor with an exposed surface of said at least one member.

14. A distribution system as claimed in claim 7 and further comprising a track power supply connector for supplying electrical power to the track, the track power supply connector incorporating cut-out means for cutting off power supply from the track in response to an overload.

15. A low voltage two-conductor track in combination with a fixing device for fixing the track to a support, the fixing device comprising a mounting member mounted or adaped to be mounted rotatably to the support and a connecting piece slidingly connected or adapted to be slidingly connected to the track by means of an undercut tongue and groove, the mounting member being adapted to receive the connecting piece in one rotational position and to interlock therewith in another rotational position.

16. The combination as claimed in claim 15 wherein the two-conductor track comprises an outer metal casing forming one of the conductors, an inner metal conductor forming the other of the conductors and insulation supporting the inner metal conductor within the outer metal casing and insulating the two conductors electrically from each other, said outer metal casing, inner metal conductor and insulation all extending continuously along the whole length of the track, both conductors being exposed for electrical contact with an adaptor applied to the track anywhere along the length of the track.

17. The combination as claimed in claim 16 wherein the inner metal conductor is a strip which is retained by two lips of the insulation and wherein two wing portions of the insulation are retained by two lips of the outer metal casing.

18. The combination as claimed in claim 16 wherein at least one member of a different metal from the metal of the casing is partly embedded in and extends along the casing and has an exposed surface extending along the casing.

19. The combination as claimed in claim 15 together with an adaptor, the adaptor comprising a support which can be mechanically interlocked with the track, and an electrical contact assembly which is freely rotatably carried by the support, said contact assembly comprising an electrical centre contact and an electrical outer contact adapted and arranged for respectively contacting the two conductors of the track in any rotational position of the contacts, two terminals connected electrically to the two contacts respectively and rotatable as one therewith, and insulating support means for the contacts and terminals, said insulating support means also being rotatable as one therewith.

20. The combination as claimed in claim 15 and further comprising a track power supply connector for supplying electrical power to the track, the track power supply connector incorporating cut-out means for cutting off power supply from the track in response to an overload.

21. A low voltage distribution system comprising a two-conductor track and an adaptor which can be fitted thereto anywhere along the track, said adaptor comprising a support having means which can be mechanically interlocked with the track, including at least one movable member for positively displacing at least one interlocking member into interlocking engagement with the track, the interlocking member normally being resiliently biased out of said interlocking engagement, said adaptor further comprising an electrical contact assembly which is freely rotatably carried by the support, said contact assembly comprising an electrical centre contact and an electrical outer contact adapted and arranged for respectively contacting the two conductors of the track in any rotational position of the contacts, two terminals connected electrically to the two contacts respectively and rotatable as one therewith, and insulating support means for the contacts and terminals, said insulating support means also being rotatable as one therewith.

* * * * *